United States Patent [19]

Noguchi et al.

[11] 4,021,249

[45] May 3, 1977

[54] HEAT DEVELOPABLE LIGHT-SENSITIVE MATERIAL INCORPORATING A SUBSTITUTED s-TRIAZINE-2,4,6-(1H, 3H, 5H)-TRIONE REDUCING AGENT

[75] Inventors: Yasuhiro Noguchi, Tokyo; Toshinao Ukai, Asaka; Kenji Sashihara, Asaka; Takao Masuda, Asaka, all of Japan

[73] Assignee: Fuji Photo Film Co., Ltd., Minami-ashigara, Japan

[22] Filed: Sept. 12, 1975

[21] Appl. No.: 612,984

[30] Foreign Application Priority Data

Sept. 12, 1974 Japan ..... 49-105290

[52] U.S. Cl. ..... 96/114.1; 96/76 R; 96/95

[51] Int. Cl.[2] ..... G03C 1/02; G03C 1/48; G03C 1/06

[58] Field of Search ..... 96/114.1, 95, 109, 66 R, 96/76 R

[56] References Cited

UNITED STATES PATENTS

| | | | |
|---|---|---|---|
| 2,857,274 | 10/1958 | Land et al. | 96/66 R |
| 2,857,276 | 10/1958 | Land et al. | 96/66 R |
| 3,457,075 | 7/1969 | Morgan et al. | 96/114.1 |
| 3,775,128 | 11/1973 | Yamamoto et al. | 96/109 |

*Primary Examiner*—Edward C. Kimlin
*Assistant Examiner*—L. Falasco
*Attorney, Agent, or Firm*—Sughrue, Rothwell, Mion, Zinn & Macpeak

[57] ABSTRACT

A heat developable light-sensitive material having reduced fog, increased whiteness, and stability to normal room illumination comprising a support having therein or in one or more layers thereon (a) an organic silver salt, (b) a light-sensitive silver halide or a component capable of forming a light-sensitive silver halide upon reaction with the organic silver salt (a), and (c) as a reducing agent an s-triazine-2,4,6-(1H, 3H, 5H)-trione substituted with a phenol derivative (having a substituted group in at least one of the o-positions thereof with respect to the hydroxyl group) in at least one of the 1-, 3- or 5-positions.

11 Claims, No Drawings

HEAT DEVELOPABLE LIGHT-SENSITIVE MATERIAL INCORPORATING A SUBSTITUTED s-TRIAZINE-2,4,6-(1H, 3H, 5H)-TRIONE REDUCING AGENT

BACKGROUND OF THE INVENTION

1. Field of the Invention

This invention relates to heat developable light-sensitive material and particularly to heat developable light-sensitive materials containing a certain reducing agent resulting in reduced thermal fog of the background, increased whiteness and high stability to normal room illumination.

2. Description of the Prior Art

The most widely used photographic process is a process in which silver halides are employed since such a photographic process has superior photographic properties such as sensitivity and gradation to other photographic processes such as an electrophotographic process and a diazo process. There are, however, disadvantages in the silver halide photographic process. For example, the silver halide light-sensitive element must be developed in an aqueous developing solution after exposure and the thus developed light-sensitive element must be further subjected to several aqueous solution processings such as stopping, fixing and stabilization in order to prevent the thus formed image from discoloring or fading and to prevent the undeveloped white areas in the image (background) from darkening. These solution processings are time-consuming and troublesome, and the chemicals employed in these processings are hazardous in handling and stain the worker's body and clothes and the processing room and further may give rise to water pollution if the solutions are discharged without treatment.

Therefore, a light-sensitive element which utilizes high speed silver halides can be processed in a dry manner without using processing solutions and which is, moreover, capable of forming a stable image with minimized discoloration in the background areas thereof under normal room illumination has been desired.

To achieve such, various efforts have been made. For example, German Pat. Nos. 1,123,203 and 1,174,157 disclose that heat development of a silver halide light-sensitive element is possible by incorporating therein a 3-pyrazolidone type developing agent. German Pat. No. 1,175,075 discloses that the heat-developability of the element can be promoted by incorporating therein a material capable of forming water, and German Pat. No. 1,003,578 discloses the additional incorporation therein of a fixing agent for the silver halide. According to the above-described techniques, however, the silver halide itself remaining in the element after the dry processing would never be completely stabilized against light by a dry process, that is, the former three patents do not described a dry fixing step, and in the light-sensitive element described in the last patent it can be easily appreciated that the copresence of a developing agent (a reductant) and a fixing agent during storage would give rise to an undesirable reaction, which makes the element not very practical. This has been confirmed experimentally.

At present the most successful light-sensitive element capable of forming a photographic image by a dry processing method is a heat developable light-sensitive element employing a composition comprising a silver salt of an organic acid, a small amount of a light-sensitive silver halide and a reducing agent, e.g., as described in U.S. Pat. Nos. 3,152,904 and 3,457,075. In this light-sensitive system the silver halide, which remains in the element after development, is not stabilized against light and allowed to be discolored by light. Nevertheless the element provides results as if it were stabilized, because the silver halide is used in a slight amount and most of the silver source is a white or light-colored organic silver salt which is stable and hardly blackened by light. Thus even if a small amount of silver halide is discolored by light, the slight discoloring does not give rise to any difficulties visually since the element, on the whole, still appears white or only slightly colored. The light-sensitive element is stable at normal temperature, but when it is image-wise exposed and heated to a temperature, usually, above about 80° C, preferably above 100° C, the organic silver salt oxidizing agent and the reducing agent which are present in the light-sensitive element undergo oxidation-reduction reactions due to the catalytic action of the exposed silver halide present in the vicinity thereof to form silver. By this reaction, the exposed areas of the light-sensitive layer are rapidly blackened so that a contrast is formed between the exposed areas and the unexposed areas (background), that is, an image is formed.

The present invention relates to an improvement in the above-described heat developable light-sensitive materials, particularly in the reducing agents incorporated therein, and an object is to employ a reducing agent giving rise to improved properties. In order for reducing agents to be an effective constituent of heat developable light-sensitive materials, the reducing agent must be capable of reducing organic silver salts when heated in presence of exposed silver halide as a catalyst, that is, they must exhibit a heat developable property. Reducing agents which have already been proposed in the art include substituted phenols, substituted mono- and bis-naphthols, di- and poly-hydroxybenzenes, di- and polyhydroxynaphthalenes, hydroquinone monoethers, ascorbic acid and the derivatives thereof, 3-pyrazolidones, pyrazoline-5-ones, reducing saccharide, p-phenylenediamine and the derivatives thereof, reductones, kojic acid, hinokitiol, hydroxylamines, hydroxytetronic acid, hydroxytetronamides, hydroxaminic acids, sulfohydoroxaminic acids, hydrazides, indan-1,3-diones, p-oxyphenylglycine and so on. A number of patents are concerned with these reducing agents, for example, U.S. Pat. Nos. 3,152,904; 3,457,075; 3,531,286; 3,615,533; 3,679,426; 3,672,904; 3,751,252; 3,751,255; 3,782,949; 3,770,448 and 3,773,512: German Patent Application OLS No. 2,031,748: and Belgian Pat. No. 786,086.

However, these reducing agents undesirably cause the exposed area of a light-sensitive material to become black in the process of heat development, namely a large amount of thermal fog is produced by these reducing agents. Even if heat-development is conducted within a comparatively short time, light-sensitive materials containing such reducing agents also have light yellowish brown stains in the background. Moreover, the background of these processed light-sensitive materials become yellowish brown due to diffuse room light.

A solution of the above-described problems inherent in conventional techniques has been an important subject in the art of heat developable light-sensitive materials.

SUMMARY OF THE INVENTION

Therefore, an object of the present invention to provide a heat developable light-sensitive material having a remarkably reduced thermal fog in the background.

Another object of the present invention is to provide a heat developable light-sensitive material which has increased whiteness and an excellent appearance.

A further object of the present invention is to provide a heat developable light-sensitive material which is exceedingly stable to diffuse light after being developed.

These and other objects of the present invention will become apparent from the following descriptions of the invention.

The above-described objects of the invention are attained by the heat developable light-sensitive material of the present invention which comprises a support having therein or in one or more layers thereon (a) an organic silver salt, (b) a light-sensitive silver halide or a component capable of forming a light-sensitive silver halide upon reaction with the organic silver salt and (c) as a reducing agent, an s-triazine-2,4,6-(1H, 3H, 5H)-trione substituted with a phenol derivative (having a substituted group in at least one of the ortho-position thereof with respect to the hydroxyl group thereof) in at least one of the 1-, 3- or 5-positions.

DETAILED DESCRIPTION OF THE INVENTION

In the present invention, component (c) is a most characteristic feature and is an s-triazine-2,4,6-(1H, 3H, 5H)-trione substituted in at least one of the 1-, 3- or 5-positions, preferably in two or all three of these positions, with a substituent derived from a phenol having a substituted group, preferably a bulky substituted group, in at least one orthoposition thereof, as described above, which acts mainly as a reducing agent.

The reducing agents advantageously used in the practice of the present invention have the following general formula (I):

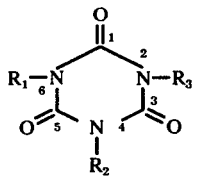

(I)

wherein $R_1$, $R_2$ and $R_3$ each represents a hydrogen atom, an alkyl group having 1 to 16 carbon atoms, for example, $-CH_3$, $-C_2H_5$, $-C_6H_{13}$, $-C_{12}H_{25}$, $-C_{16}H_{33}$, etc., or a Q group, with at least one of $R_1$, $R_2$ and $R_3$ being a Q group and the Q group being represented by the following general formula (II):

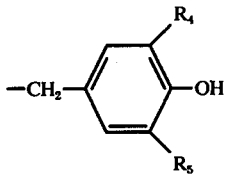

(II)

wherein $R_4$ represents an alkyl group having 1 to 20 carbon atoms (such as a methyl group, an ethyl group, a propyl group, an isopropyl group, a butyl group, a secondary butyl group, a tertiary butyl group, a 1,1-dimethylpropyl group, a hexyl group, an octyl group, a decyl group, a dodecyl group, a tetradecyl group, a hexadecyl group, etc., particularly preferably a tertiary butyl group, a dodecyl group or a hexadecyl group), and $R_5$ represents a hydrogen atom or an alkyl group as described for $R_1$, which alkyl group may be the same as or different from $R_1$.

Specific examples are as follows, wherein all alkyl groups are normal alkyl groups unless otherwise indicated and a tertiary butyl group is abbreviated as X:

| Compound Number | $R_1$ | $R_2$ | $R_3$ |
|---|---|---|---|
| 1 | 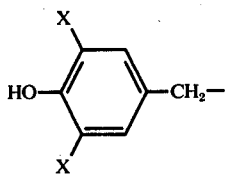 | 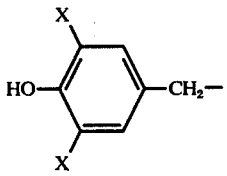 | n-$C_6H_{13}$ |
| 2 | 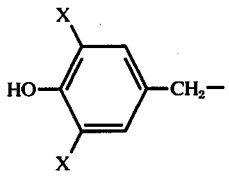 | 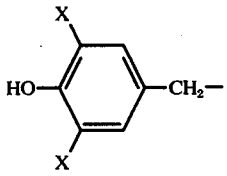 | n-$C_{12}H_{25}$ |
| 3 | 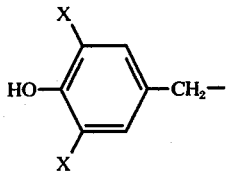 | 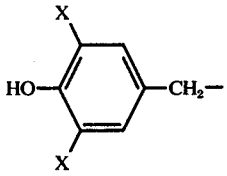 | n-$C_{16}H_{23}$ |

-continued
| Compound Number | $R_1$ | $R_2$ | $R_3$ |
|---|---|---|---|
| 4 | 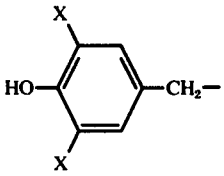 | 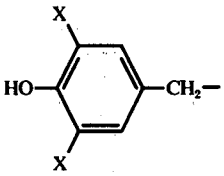 | 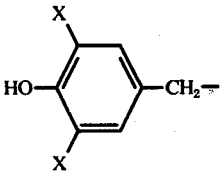 |
| 5 | 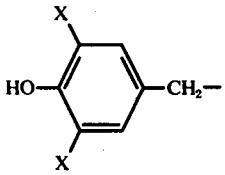 | 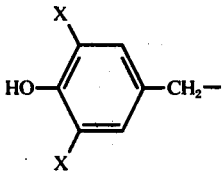 | H |
| 6 | 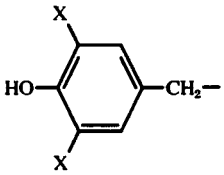 | 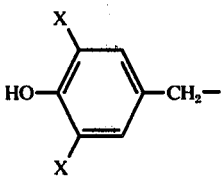 | 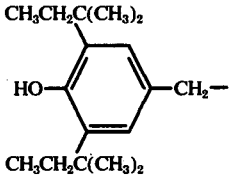 |
| 7 | 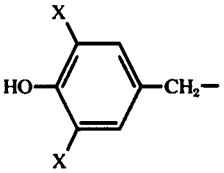 | 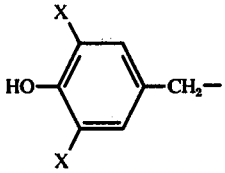 | 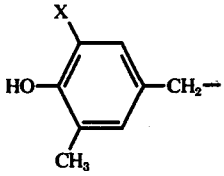 |
| 8 | 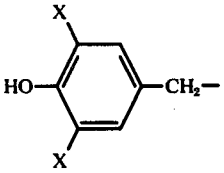 | 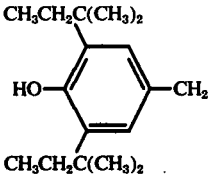 | 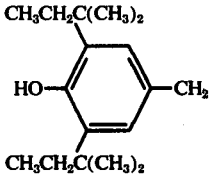 |
| 9 | 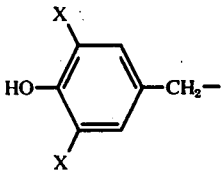 | 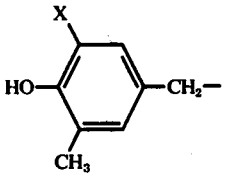 | 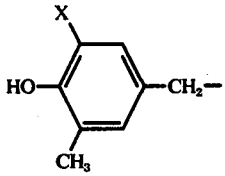 |
| 10 | 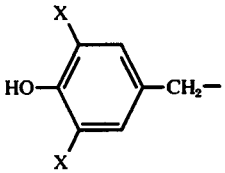 | H | H |
| 11 | 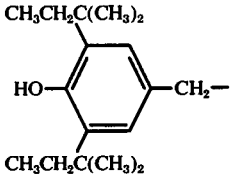 | 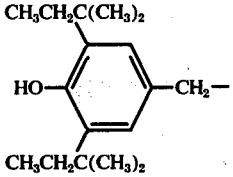 | 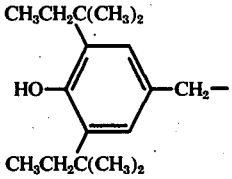 |
| 12 | 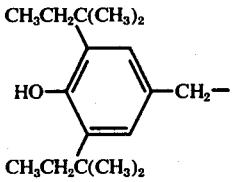 | 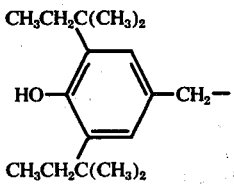 | 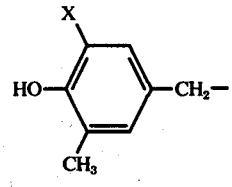 |

-continued

| Compound Number | $R_1$ | $R_2$ | $R_3$ |
|---|---|---|---|
| 13 | 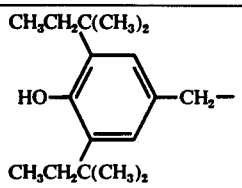 | 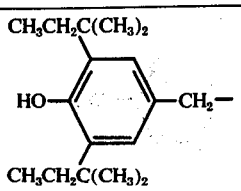 | H |
| 14 | 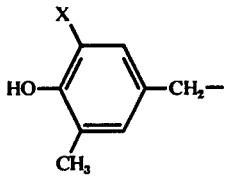 | 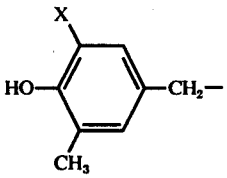 | 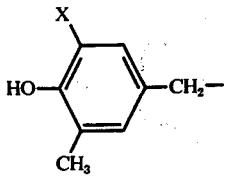 |
| 15 | 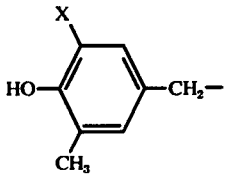 | 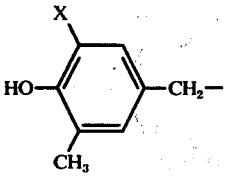 | 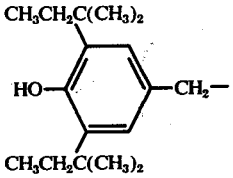 |
| 16 | 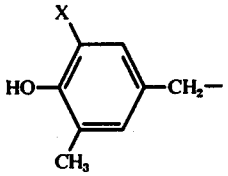 | 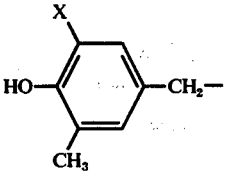 | H |
| 17 | H | H | 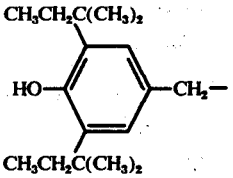 |
| 18 | H | H | 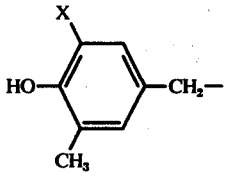 |
| 19 | 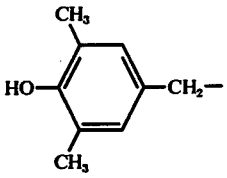 | 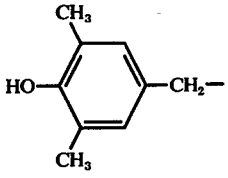 | 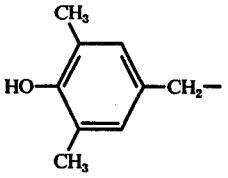 |
| 20 | 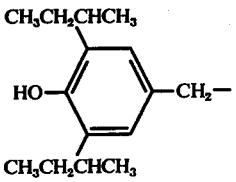 | 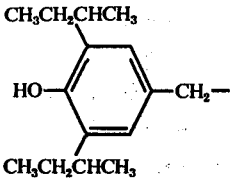 | 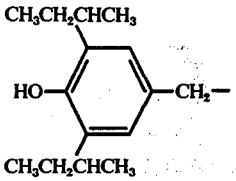 |

All of the compounds described above as specific examples of the reducing agents of this invention are known compounds and are known to be effective stabilizing agents for high molecular weight materials. See, for example, Goodrich Chemical Company "Good-rite 3114 Antioxidant", Good-rite 3114 Antioxidant Newsletter No. 2.

The above-described compounds of the present invention can be used individually as a reducing agent, and two or more of these compounds can also be employed as a reducing agent. In some cases, it is possible to control the reducing power of the reducing agent of this invention by using such in combination with known reducing agents, which act as an assistant, as described hereinafter.

The reducing agent used in the practice of the present invention exhibits its inherent functions even if it is added at any step in production of heat developable light-sensitive materials, but addition just before the coating-drying procedures is somewhat preferred because heat fog is reduced.

The reducing agents of the present invention are effective in most cases when used in an amount ranging from about 0.1 mol to 10 mol, preferably from about 1/3 mol to 3 mol, per mol of the organic silver salt.

The organic silver salts employed as component (a) in the invention are colorless, white or slightly colored silver salts which are comparatively stable to light and which react with the reducing agents to form silver images when heated to a temperature of about 80° C or higher, preferably 100° C or higher, in the presence of an exposed silver halide. Examples of organic silver salts include silver salts of organic compounds containing an imino group, a mercapto group, a thione group or a carboxyl group. Typical examples of these organic silver salts include:

1. Silver salts of organic compounds containing an imino group:

Silver benzotriazole, silver nitrobenzotriazole, silver alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

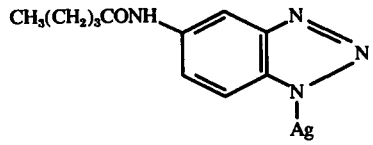

or

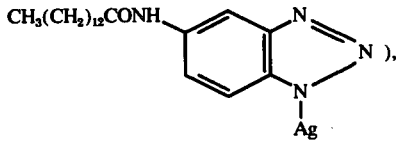

silver benzimidazole silver substituted-benzimidazoles (e.g., silver 5-chlorobenzimidazole or silver 5-nitrobenzimidazole), silver carbazole, silver saccharin, silver phthalazinone, silver substituted-phthalazinone, silver salts of phthalimides, silver pyrrolidone, silver tetrazole and silver imidazole;

2. Silver salts of organic compounds containing a mercapto group or a thione group:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japanese Patent Application (OPI) 28221/73 (e.g., silver 2-(S-ethylenethioglycolamido)benzthiazole or silver S-alkyl-($C_{12}$ – $C_{22}$)thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithiohydroxybenzole, silver mercaptotriazine, silver 2-mercaptobenzoxazole and silver mercaptooxadiazole, etc.;

3. Silver salts of organic compounds containing a carboxylic group:

a. Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

b. Silver aromatic carboxylates and the others:

Silver benzoate, silver 3,5-dihydroxybenzoate, silver o-methylbenzoate, silver m-methylbenzoate, silver p-methyl-benzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyromellitate, silver 4'-n-octadecyloxydiphenyl-4-carboxylate, silver thionecarboxylates as disclosed in U.S. Pat. No. 3,785,830 and silver salts of aliphatic carboxylic acids containing a thioether group as disclosed in U.S. Pat. No. 3,330,663;

4. Other silver salts:

Silver 4-hydroxy-6-methyl-1,3,3a,7-tetraazaindene, silver 5-methyl-7-hydroxy-1,2,3,4,6-pentaazindene, silver tetraazindene as disclosed in British Pat. No. 1,230,642, silver S-2-aminophenylthiosulfate as disclosed in U.S. Pat. No. 3,549,379, metal-containing aminoalcohols as disclosed in Japanese Patent Application (OPI) 6586/71, and organic acid-metal chelates as disclosed in Belgian Pat. No. 768,411.

An oxidizing agent such as titanium dioxide, zinc oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a water-miscible solvent, such as an alcohol or acetone, or water is mixed with an aqueous solution of a water-soluble silver salt such as silver nitrate to prepare an organic silver salt.

Further, it is possible to use the process described in U.S. Pat. No. 3,839,049 wherein a colloidal dispersion of an ammonium salt or an alkali metal salt of an organic silver salt forming agent is mixed with an aqueous solution of a water-soluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process, organic carboxylic acid silver salts are prepared by mixing a substantially water immiscible solution (oily solution) such as a benzene solution of an organic carboxylic acid with an aqueous solution of a silver complex salt. Preferably the water is added to the oily solution to form an emulsion prior to mixing with the aqueous solution of the silver complex salt. This process can be also applied to the preparation of other arganic silver salts.

A similar process has been described in Canadian Patent 847,351 wherein the resulting organic silver salts are more stable to heat and light. In this process, a silver salt solution free of alkali, such as an aqueous solution containing only silver nitrate, is used instead of the silver complex salt.

Further, a process for preparing organic silver salts is described in West German Patent Application (OLS) 2,402,906. This process is preferred because heat-developable light-sensitive materials containing the resulting organic silver salt do not form as much heat-fog (undesirable fog generated on the unexposed area when the light-sensitive material is heated). Namely, this process comprises mixing an emulsion composed of an aqueous solution of a salt (for example, an alkali metal salt such as a sodium salt, a potassium salt or a lithium salt or an ammonium salt, etc.) of a water-soluble organic silver salt forming agent and an oil (for example, benzene, toluene, cyclohexane, pentane, hexane, carboxylic acid esters such as an acetate, phosphoric acid esters, and oils such as castor oil, etc.) with a solution of, and preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, and preferably an aqueous solution, of a soluble silver salt such as silver nitrate or a silver complex salt such as a silver ammine complex salt.

The oils which can be used for the above-described oily solution include the following compounds:

1. Phosphoric acid esters:
For example, tricresyl phosphate, tributyl phosphate, and monooctyl dibutyl phosphate, etc.
2. Phthalic acid esters:
For example, diethyl phthalate, dibutyl phthalate, dimethyl phthalate, dioctyl phthalate and dimethoxyethyl phthalate, etc.;
3. Carboxylic acid esters:
For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc.; tartarates such as diethyl tartarate; valerates such as ethyl valerate; butyrates such as methyl butyrate, ethyl butyrate, butyl butyrate and isoamyl butyrate; and adipic acid esters, etc.;
4. Oils such as castor oil, cotton seed oil, linseed oil and tsubacki oil, etc.;
5. Aromatic hydrocarbons such as benzene, toluene and xylene, etc.;
6. Aliphatic hydrocarbons such as pentane, hexane and heptane, etc.; and
7. Cyclic hydrocarbons such as cyclohexane.

Examples of silver complex salts include silver ammine complex salt, silver methylamine complex salt and silver ethylamine complex salt, and preferably alkali-soluble complex salts having a dissociation constant higher than the organic silver salts, are suitably used.

Examples of solvents for the silver salts such as silver nitrate include not only water but also polar solvents such as dimethyl sulfoxide, dimethylformamide and acetonitrile, etc.

Further, ultrasonic waves can be employed during the preparation of the organic silver salts as described in West German Patent Application (OLS) 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process has been described in U.S. Pat. No. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid such as a silver salt thereof. A process which comprises reacting a colloid dispersion of an organic silver salt forming agent with an aqueous solution of silver nitrate has been described in U.S. Pat. No. 3,839,049. Furthermore, a process for producing an emulsion using similar non-aqueous solutions has been described in U.S. Pat. No. 3,748,143. In addition, it is possible, as described in Japanese Patent Application (OPI) 13224/1974 and West German Patent Application (OLS) 2,322,096, to change the particle form, the particle size and photographic properties such as light stability or sensitivity of the organic silver salts due to the presence of a metal salt or a metal complex such as a mercury or lead compound during the preparation of the organic silver salts.

It has been also confirmed that cobalt, manganese, nickel, iron, rhodium, iridium, platinum, gold, cadmium, zinc, lithium, copper, thallium, tin, bismuth, antimony, chromium, ruthenium, palladium and osmium, in addition to the mercury and lead described above, are effective as the metal. In order to use these metal containing compounds, a mixture or dispersion of a solution of a silver salt forming organic compound and a metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprising mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide.

The particle size of thus-resulting organic silver salts is about 0.01 micron to about 10 microns as the longer diameter, preferably about 0.1 micron to about 5 microns.

Examples of light-sensitive silver halides which can be employed as component (b) in the invention include silver chloride, silver bromide, silver iodide, silver chlorobromoiodide, silver chlorobromide, silver chloroiodide, silver iodobromide and a mixture thereof. The light-sensitive silver halide can be coarse particles or fine particles, but preferably is fine particles. A preferred particle size of the silver halide is about 0.001 to 1 micron, more preferably about 0.01 to 0.5 micron, in the longer diameter. A suitable amount of the silver halide can range from about 0.001 mole to about 0.5 mole, preferably 0.01 mole to 0.3 mole, per mole of the organic silver salt (a).

The light-sensitive silver halide can be prepared by any of the procedures known in the field of photography, such as a single jet procedure and a double jet procedure. Examples of silver halides used in this invention include these prepared by a Lippmann process, an ammoniacal process and thiocyanate or thioether ripening process. The silver halide used can be unwashed or washed, e.g., with water, alcohols, etc., to remove soluble salts.

The silver halide used in the invention can be chemically sensitized with a chemical sensitizer such as sulfur, selenium, tellurium, gold, platinum, palladium, a stannous halide, etc., e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatechol, an oxime, a nitron, a nitroindazole, etc., to stabilize the silver halide to fog, e.g., as disclosed in U.S. Pat. Nos. 2,728,663, 2,839,405, 2,566,263, 2,597,915 and British Pat. No. 623,448.

The silver halide emulsion prepared in advance can be mixed with an oxidation-reduction composition comprising an organic silver salt and a reducing agent, as described in U.S. Pat. No. 3,152,904. According to this method, however, sufficient contact is not attained between the silver halide and the organic silver salt (e.g., as disclosed in U.S. Pat. No. 3,457,075). In order to achieve good contact between the silver halide and the organic silver salt, various techniques can be employed. One effective technique is to mix the materials in the presence of a surface active agent, as described in Japanese Patent Application Nos. 82852/72 and 82851/73. According to another method a silver halide is prepared in the presence of a polymer and then mixed with an organic silver salt (for example, as disclosed in U.S. Pat. Nos. 3,705,565; 3,713,833; 3,706,564 and 3,761,273; French Pat. Nos. 2,107,162 and 2,078,586; and Belgian Pat. No. 774,436).

The light-sensitive silver halide employed in the invention can be simultaneously prepared with the preparation of the organic silver salt as disclosed in Japanese Patent Application 65727/73. That is, the silver halide can be prepared by mixing a silver salt (e.g., silver nitrate or a silver complex salt) solution with a solution or dispersion of an organic silver salt-forming compound or a salt thereof and a silver halide forming compound solution, or by mixing a silver halide-forming compound solution and a solution or dispersion of an organic silver salt-forming compound or a salt thereof and a solution of a silver salt such as silver nitrate or a silver complex salt, whereby silver halide is prepared simultaneously with the organic silver salt. Further, the light-sensitive silver halide employed in the invention can be prepared by a partial conversion of the organic silver salt by subjecting a solution or dispersion of the previously prepared organic silver salt to a silver halide forming compound or a sheet material containing an organic silver salt to a silver halide forming compound. The thus-prepared silver halide is effectively contacted with the organic silver salt to provide preferred results as disclosed in U.S. Pat. No. 3,457,075.

The light-sensitive silver halide forming components which can be employed in this invention include any compounds capable of forming silver halide on reaction with the organic silver salt. Whether the compounds can be employed as a silver halide forming component can be determined by a routine test. For example, after mixing a compound for forming a silver halide with the organic silver salt, and, if necessary heating, the X-ray diffraction pattern obtained by an X-ray diffraction method is examined to determine whether diffraction peaks inherent to silver halide are present.

Examples of silver halide forming components include the following compounds.

1. Inorganic halides:

For example, halides represented by the formula $MX'_n$, wherein M represents H, $NH_4$ or a metal atom, X' represents Cl, Br or I, and $n$ is 1 if M represents H or $NH_4$, or n represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

2. Halogen containing metal complexes:

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

3. Onium halides:

For example, quaternary ammonium halides such as trimethylphenyl ammonium bromide, cetylethyldimethyl ammonium bromide and trimethylbenzyl ammonium bromide, quaternary phosphonium halides halides such as trimethyl sulfonium iodide. Further, these onium halides can be used in final coating dispersions for the purpose of decreasing sensitivity or, if desired, decreasing the background density, as described in U.S. Pat. No. 3,679,422.

4. Halogenated hydrocarbons:

For example, iodoform, bromoform, carbon tetrabromide and 2-bromo-2-methylpropane, etc.

5. N-halogen compounds:

For example, compounds represented by the following formulae:

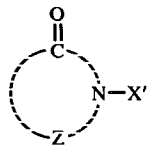
(III)

and

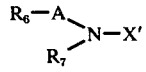
(IV)

wherein X' represents Cl, Br or I; Z represents a group of atoms necessary to form a 5- or 6-membered ring, wherein the 5- or 6-membered ring may be condensed with another ring; A represents a carbonyl group or a sulfonyl group; and $R_6$ and $R_7$ each represents an alkyl group, an aryl group or an alkoxy group. For example, N-bromosuccinimide, N-bromophthalimide, N-bromoacetamide, N-iodosuccinimide and N-bromophthaladinone, etc., are suitable. These compounds have been described in detail in West German Patent Application (OLS) 2,453,131. In addition, N-halo compounds of benzotriazole and substituted benzotriazoles such as the alkyl, nitro, halo, imido or amino substituted benzotriazoles are also effective. Furthermore, N-bromobenzimidazoles are suitable.

6. Other halogen containing compounds:

For example, triphenylmethyl chloride, triphenylmethyl bromide, 2-bromobutyric acid, 2-bromoethanol and dichlorobenzophenone, etc.

In the above-described processes and the process of the present invention, the improvement of photographic properties, such as increase of sensitivity and elimination of heat-fog, etc., can be achieved by ripening by allowing the composition to stand at room temperature (about 20° to 25° C) to a higher temperature (30° C to 80° C) for a suitable time (for example, 20 minutes to 48 hours) after addition of the silver halide forming component.

The silver halide forming compound can be employed individually or as a combination thereof. A suitable amount of the silver halide forming component is about 0.001 to 0.5 mol, preferably about 0.01 to 0.3 mol, per mol of the organic silver salt employed as the component (a). If the amount is more than about 0.5 mol, the color changes which is an undesirable coloration of the background which occurs on allowing the exposed and developed light-sensitive material to stand under normal room illumination. If the amount is less than about 0.001, the sensitivity is reduced.

Reducing agents which have been employed for conventional heat developable light-sensitive materials can also be added to the heat developable light-sensitive material of the present invention addition to the reducing agents characteristic of this invention. Although the suitability of the reducing agents is determined by the organic silver salt with which it is used combination, reducing agents generally include substituted phenols, substituted or unsubstituted biphenols, substituted or unsubstituted mono- or bis-naphthols, di- or poly-hydroxy benzenes, di- or poly-hydroxynaphthalenes, hydroquinone monoethers, ascorbic acid or derivatives thereof, 3-pyrazolidone, pyrazolin-5-ones, reducing saccharides, p-phenylenediamine or the derivatives thereof, reductones, kojic acid, hinokitiol, hydroxylamine, hydroxytetronic acid, hydroxytetronamides, hydroxaminic acids, sulfhydroxaminic acids, hydrazides, indan-1,3-diones, p-oxyphenylglycines and so on. Of these reducing agents, reducing agents which will decompose when exposed to light are preferred in the present invention. These reducing agents which decompose on exposure are disclosed, for example, in British Pat. No. 1,163,187. In addition, compounds which accelerate photolysis can be used in combination, and are described in, for example, U.S. Pat. No. 3,589,903; Japanese Patent Application Nos. 81625/73 and 22135/74. Reducing agents of the blocked bisphenol system can be effectively used such as compounds as disclosed in U.S. Pat. No. 3,756,829.

Specific examples of other reducing agents which can be employed in the practice of the present invention are disclosed in, for example, U.S. Pat. Nos. 3,152,904; 3,457,075; 3,531,286; 3,615,533; 3,679,426; 3,672,904; 3,751,252; 3,751,255; 3,782,949; 3,770,448 and 3,773,512; British Pat. No. 1,338,427; Belgian Pat. No. 786,086 and so on.

Examples of suitable reducing agents are as follows:

1. Substituted phenols:

Aminophenols, for example, 2,4-diaminophenol, methylaminophenol, p-aminophenol, o-aminophenol, 2-methoxy-4-aminophenol and 2-β-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenyl and p-octylphenol, etc.; other phenols, for example, p-acetophenol, p-acetoacryl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds described in U.S. Pat. No. 3,801,321; and novolak resin type reaction products of formaldehyde and phenol derivatives (for example, 4-methoxyphenol, m-cresol, o- or p-butylphenol, 2,6-di-t-butylphenol and mixtures thereof, etc.);

2. Substituted or unsubstituted bisphenols:

o-bis-Phenols, for example, 1,1-bis-(2-hydroxy-3,5-dimethylphenyl)-3,5-trimethylhexane, bis-(2-hydroxy-3-t-butyl-5-methylphenyl)methane, bis-(2-hydroxy-3,5-di-t-butylphenyl)methane, bis-(2-hydroxy-3-t-butyl-5-ethylphenyl)methane, 2,6-methylene-bis-(2-hydroxy-3-t-butyl-5-methylphenyl)-4-methylphenol, 1,1-bis-(5-chloro-2-hydroxyphenyl)methane, 2,2'-methylene-bis-[4-methyl-6-(1-methylcyclohexyl)-phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)-di-(o-cresol), 4,4'-ethyldene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(o-cresol); and others, for example, 3,5-di-t-butyl-4-hydroxybenzyldimethylamine, polyphenols such as α, α'-(3,5-di-t-butyl-4-hydroxyphenyl)dimethylether, 2,4,6-tris-(3,5-di-t-butyl-4-hydroxybenzyl)phenol, N,N'-di-(4-hydroxyphenyl)-urea and tetrakis-[methylene-(3,5-di-t-butyl-4-hydroxyhydrocinnamate]methane, diethylstilbestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

3. Substituted or unsubstituted mono- or bis-naphthols and di- or polyhydroxynaphthalenes:

bis-β-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl; naphthols, for example, α-naphthol, β-naphthol, 1-hydroxy-4-aminoaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid and sulfonamidonaphthols.

4. Di- or polyhydroxybenzenes and hydroxymonoethers (e.g., as described in U.S. Pat. No. 3,801,321):

Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogen-substituted hydroquinones, for example, chlorohydroquinone, dichlorohydroquinone and bromohydroquinone, etc.; alkoxy-substituted hydroquinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

5. Ascorbic acid and derivatives thereof:

l-Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

6. 3-Pyrazolines, 3-pyrazolidones and pyrazolones:

For example, 1-phenyl-3-pyrazolidone, 4-methyl-4-hydroxymethyl-1-phenyl-3-pyrazolidone, the compounds described in British Pat. No. 930,572, and 1-(2-quinolyl)-3-methyl-5-pyrazolone, etc.

7. Reducing saccharides:

For example, glucose and lactose, etc.

8. Aromatic primary amino compounds:

Examples of typical compounds include N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline and 3-methyl-4-amino-N-ethyl-N-(β-hydroxyethyl)aniline, 4-amino-3-methyl-N-ethyl-N-(β-methanesulfoamiddoethyl)aniline sesquisulfate monohydrate as described in U.S. Pat. No. 2,193,015, N-(2-amino-5-diethylaminophenylethyl)methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Patent Application (OPI) 64933/1973, and the inorganic salts thereof. These compounds have been described in L.F.A. Mason, *Photographic Processing Chemistry*, pages 226–229, Focal Press, London (1966).

9. Hydroxylamines:

For example, N,N-di-(2-ethoxyethyl)hydroxylamine, etc.

10. Reductones:

Anhydro-dihydroaminohexose reductones as described in, for example, U.S. Pat. No. 3,679,426, and linear aminoreductones as described in Belgian Pat. No. 786,086.

11. Hydroxamic acids:

For example, hydroxamic acids as described in U.S. Pat. Nos. 3,571,252 and 3,751,255.

12. Hydrazides:

For example, hydroxy substituted aliphatic acid aryl hydrazides as described in U.S. Pat. No. 3,782,949.

13. Other compounds:

For example, pyrazoline-5-ones as described in U.S. Pat. No. 3,770,448, indan-1,3-diones having at least one hydrogen atom at the 2-position thereof as described in U.S. Pat. No. 3,773,512; amidoximes as described in U.S. Pat. No. 3,794,488, and reducing agents as described in U.S. Pat. No. 3,615,533 and U.S. Pat. No. 3,819,382.

Of these reducing agents, the compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and color change due to exposure to light is small. For example, mono-, bis-, tris or tetrakis phenols having a 2,6-di-tert-butyl-phenol group are preferred examples of reducing agents. Typical examples of these compounds are (i) esters of carboxylic acids derived from phenols having a bulky substituent in at least one ortho-position with monohydric or polyhydric alcohols or phenols, and (ii) esters of alcohols derived from phenols having a bulky substituent in at least one ortho-position or phenols having a bulky substituent in at least one ortho-position with mono- or polycarboxylic acids. These esters can be represented by the formulae:

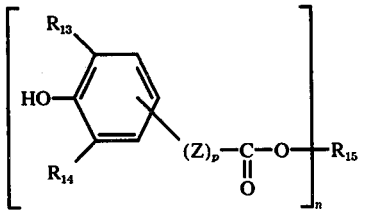

(V)

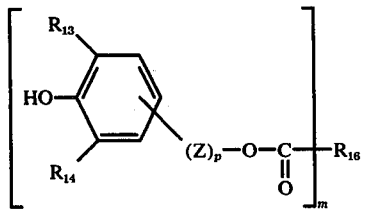

(VI)

wherein Z is a divalent group containing up to 30 carbon atoms, $R_{13}$ is an alkyl group having 1 to 20 carbon atoms, $R_{14}$ is a hydrogen atom or an alkyl group having 1 to 20 carbon atoms, $R_{15}$ is an alcohol residue, $R_{16}$ is a carboxylic acid residue, *n* and *m* each is a positive integer which is equal to the number of alcohol and carboxylic acid residues, respectively, esterified, and *p* is 0 or 1. Specific examples of these compounds includes tetrakis[methylene-(3,5-di-tert-butyl-4-hydroxyhydrocinnamate)]methane and octadecyl-3-(3′,5′-di-tert-butyl-4′-hydroxyphenyl)propionate.

It has been found that, of these esters, those represented by the following general formula (VII) provide an increased image density and desirable black tone when used in combination with phthalazinones, which can be present in the composition according to the invention as a particularly desirable activator toning agent as described hereinafter.

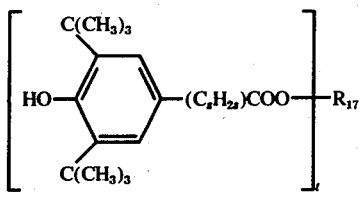

(VII)

wherein $R_{17}$ represents a residue of a saturated acyclic fatty alcohol represented by the formula $C_dH_{2d+2-t}$, wherein $d$ represents a positive integer of from 1 to 18 and t represents a positive integer of from 1 to $2d+2$, and $s$ represents 1,2,3 or 4.

Further, photodecomposable reducing agents such as ascorbic acid and the derivatives thereof, furoin, benzoin, dihydroxyacetone, glyceraldehyde, rhodizonic acid tetrahydroxyquinone, 4-methoxy-1-naphthol, etc., are preferred. They are decomposed by light even if the light-sensitive materials in which they are present are allowed to stand in the light after development, whereby reduction does not proceed and so no color change occurs. Furthermore, direct positive images can be obtained by destroying the reducing agent upon imagewise exposure as disclosed in Japanese Patent Publications 22185/70 and 41865/71.

It is known that the selection of suitable reducing agents (c) should be carried out by taking into account the extent of oxidizing power of the organic silver salt oxidizing agent (a) with which the reducing agent is to be used in combination. Phenols with steric hindrance which can be effectively used in the present invention are especially suitable for silver salts relatively easy to reduce such as silver caprate, silver laurate, silver palmitate, silver stearate, etc. However, even in the case of silver salts comparatively difficult to reduce such as silver benzotriazole, silver behenate and the like, the reducing agents of the present invention can be made suitable therefor by using an assistant reducing agent which has a stronger reducing power together therewith. Namely, 1-phenyl-3-pyrazolidones, ascorbic acid, 4-methoxy-1-naphthol and the like are suitable assistant developers for silver benzotriazole, and assistant developers such as o-bisphenols, hydroquinones and the like are suitable for a behenic acid system.

Although the appropriate amount of the assistant reducing agent which can be used in the present invention will vary because the amount depends upon the reducing power of the assistant reducing agent and the reducability of the organic silver salts, a generally effective amount ranges from about $10^{-5}$ mole to 1 mole, preferably from $10^{-3}$ mole to 0.8 mole, per mole of the main reducing agent of the present invention. A most striking aspect of the combined use of the reducing agent of the present invention and the above-described assistant reducing agent is that reduced heat fog, increased whiteness and stabilization to light after processing are observed in a similar manner to the use of the main reducing agent alone.

In forming a black image of silver using the heat developable light-sensitive material of the present invention, a color toning agent as an additive is preferably incorporated in the material. The color toning agent is used when it is desired to change the formed image into a deep color image and particularly into a black image. The amount of the color toning agent generally ranges from about 0.0001 mol to about 2 mols, and preferably about 0.0005 mol to about 1 mol, per mol of the organic silver salt. Although the color toning agent which is effective depends upon the organic silver salt and the reducing agent used, in general, heterocyclic organic compounds containing at least two hetero atoms wherein at least one nitrogen atom is present in the ring are used as a color toning agent. These compounds are described in, for example, U.S. Pat. No. 3,080,254. Phthalazone (phthalazinone), phthalic acid anhydride, 2-acetylphthalazinone, 2-phthaloylphthalazinone and substituted phthalazinone derivatives as described in West German Patent Application (OLS) 2,449,252 also can be suitably used in the present invention.

Examples of other effective color toning agents include pyrazolin-5-ones, cyclic imides and quinazolinone, as described in U.S. Pat. No. 3,846,136. For example, phthalimide, N-hydroxyphthalimide, N-potassium phthalimide and silver phthalimide are typical. Silver phthalazinone is also effective as a color toning agent. Other effective color toning agents are the mercapto compounds described in U.S. Pat. No. 3,832,186 and West German Patent Application (OLS) 2,321,217. In addition, the oxazinediones as described in West German Patent Application (OLS) 2,422,012, the phthalazine diones described in West German Patent Application (OLS) 2,449,252, the uracils described in Japanese Patent Application 18378/1974, the N-hydroxynaphthalimides described in U.S. Pat. No. 3,782,941, the substituted phthalimides described in West German Patent Application (OLS) Nos. 2,140,406, 2,141,063 and U.S. Pat. No. 3,844,797, and the phthalazinone derivatives described in West German Patent Application (OLS) No. 2,220,618 can also be used.

Preferably each component used in the present invention is included in a binder so as to provide a homogeneous film on a support. Although preferred binders are generally hydrophobic, hydrophilic binders can also be used. These binders are transparent or semi-transparent. For example, proteins such as gelatin or gelatin derivatives, polysaccharides such as dextran, natural materials such as gum arabic, vinyl, latex compounds which increase the dimensional stability of the photographic materials and synthetic polymers described hereinafter can be used. Preferred synthetic polymers are those described in U.S. Pat. No. 3,142,586, 3,193,386, 3,062,674, 3,220,844, 3,287,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Pat. No. 774,054. Examples of preferred high molecular weight materials and resins include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid-terpolymers, polyvinyl alcohol, polyvinyl acetate, benzyl cellulose, polyvinyl acetate, acetylcellulose, cellulose propionate and cellulose acetate phthalate, etc. Of these polymers, polyvinyl butyral, polyvinyl acetate, ethyl cellulose, polymethyl methacrylate and cellulose acetate butyrate are more preferred. The most preferred material is polyvinyl butyral. If desired, two or more of these materials can be used as a mixture. The ratio by weight of the binder to the organic silver salt of component (a) generally ranges from about 10:1 to about 1:10 and preferably about 4:1 to about 1:4.

The layers containing each component described herein and other layers in the present invention can be applied to many kinds of supports. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminum plate, etc. Partially acetylated materials can also be used. Further, baryta paper, synthetic resin coated paper and water-resistant paper can be used as well. It is further preferred, from the viewpoint of handling, that the support be flexible. Art paper, coated paper and clay processed paper are preferred as paper supports. Paper which has been sized with a polysaccharide, etc., is also preferred. The organic silver salt and the silver halide are each used in the amount such that the sum total of silver amount of both coated on the support is about 0.2 g to about 3 g, preferably about 0.3 g to about 2 g, per $m^2$ of the support. If the amount coated is below about 0.2 g, the image density is low. If the amount coated is above about 3 g, the cost is increased while no additional advantages in photographic properties are achieved.

Certain spectral sensitizing dyes which are known to be effective for gelatin-silver halide emulsions can be used for the heat developable light-sensitive materials of the present invention in order to further increase the sensitivity. Effective spectral sensitizing dyes include cyanine, merocyanine, complex (trinuclear or tetranuclear) cyanin, holopolar cyanine, styryl, hemicyanine, oxonol and hemioxonol dyes. Of the cyanine dyes, those containing a basic nucleus such as a thiazoline, oxazoline, pyrroline, pyridine, oxazole, thiazole, selenazole, or imidazole ring are suitable. Further, such a nucleus can have an alkyl group, an alkylene group, a hydroxyalkyl group, a sulfoalkyl group, a carboxyalkyl group, an aminoalkyl group or an enamine group as a substituent or can form a condensed carbocyclic group or heterocyclic group. The cyanine dyes can be either symmetric or asymmetric. Further, the dyes can have an alkyl group, a phenyl group, an enamine group or a heterocyclic substituent on the methine chain or the polymethine chain thereof. Particularly, cyanine dyes containing a carboxyl group are effective for sensitization. The merocyanine dyes can contain an acid nucleus such as a thiohydantoin nucleus, a rhodanine nucleus, an oxazolidindione nucleus, a thiazolidindione nucleus, a barbituric acid nucleus, a pyrazolone nucleus or a malonitrile nucleus in addition to the above-described basic nucleus. These acid nuclei can be substituted with an alkyl group, an alkylene group, a phenyl group, a carboxyalkyl group, a sulfoalkyl group, a hydroxyalkyl group, an alkoxyalkyl group, an alkylamino group or a heterocyclic nucleus. Particularly, merocyanine dyes having an imino group or a carboxyl group are effective for sensitization. If desired, these dyes can be used as a combination of two or more thereof. Further, they can be used together with ascorbic acid derivatives, azaindenes, cadmium salts, organic sulfonic acids or supersensitizing additives which do not absorb visible light as described in, for example, U.S. Pat. Nos. 2,933,390 and 2,937,089, etc. Effective sensitizing dyes for the heat developable light-sensitive materials of the present invention include merocyanine dyes containing a rhodanine nucleus, a thiohydantoin nucleus or a 2-thio-2,4-oxazolidindione nucleus as described in U.S. Pat. No. 3,761,279, for example, 3-p-carboxyphenyl-5-[β-ethyl-2-(3-benzoxazolylidenyl)ethylidenyl]-rhodanine, 5-{[3-β-carboxyethyl-2-(3-thiazolinylidenyl)-ethylidenyl]-3-ethyl}rhodanine, 3-carboxymethyl-5-[(3-methyl-thiazolinylidenyl)-α-ethylethylidenyl]rhodanine, 1-carboxymethyl-5-[(3-ethyl-2-(3H)-benzoxazolylidenyl)ethylidenyl]-3-phenyl-2-thiohydantoin, 5-[(ethyl-2-benzoxazolylidenyl)-1-methylethyl-idenyl]-3-[(3-pyrrolin-1-yl)propyl]-rhodanine and 3-ethyl-5-[(3-ethyl-2-(3H)-benzothiazolylidenyl)isopropylidenyl]-2-thio-2,4-oxazolidindione, etc. Trinuclear merocyanine dyes as described in U.S. Pat. No. 3,719,495, polynuclear aromatic dyes as described in Belgian Pat. No. 788,695, sensitizing dyes for silver iodide as described in West German Patent Application (OLS) 2,328,868, styrylquinoline dyes as described in West German Patent Application (OLS) 2,363,586, rhodacyanine dyes as described in West German Patent Application (OLS) 2,405,713, acid dyes such as 2′,7′-dichlorofluoroscein dyes as described in West German Patent Applications (OLS) 2,404,591, 2,401,982, and 2,422,337 and merocyanine dyes as described in Japanese Patent Application 10815/1974 are other examples of sensitizing dyes which can be similarly used in the present invention. Examples of effective merocyanine dyes which have pyrazolone nuclei are as follows:

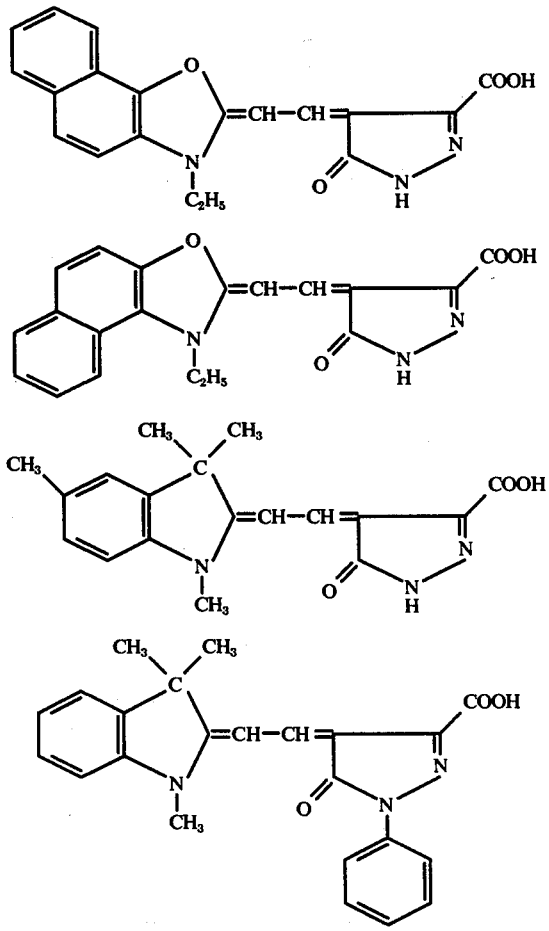

-continued

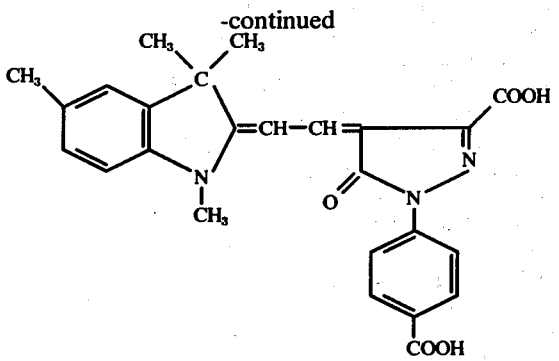

The amount of these dyes generally ranges from about $10^{-4}$ to about 1 mol per mol of the light-sensitive silver halide or the silver halide forming component.

The heat developable light-sensitive materials used in the present invention can have an antistatic layer or an electrically conductive layer. These layers can contain soluble salts such as halides or nitrates, ionic polymers as described in U.S. Pat. Nos. 2,861,056 and 3,206,312 and insoluble inorganic salts as described in U.S. Pat. No. 3,428,451. Further, the heat developable light-sensitive materials can have an evaporation-deposited metal layer. If desired, the heat developable light-sensitive materials of the present invention can contain an antihalation material of an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light-absorbing materials as described in U.S. Pat. Nos. 3,253,921, 2,527,583 and 2,956,879 can be incorporated into the heat developable light-sensitive materials of this invention.

If desired, the heat developable light-sensitive materials of the present invention can contain a matting agent such as starch, titanium dioxide, zinc oxide, silica, polymer beads such as those described in U.S. Pat. Nos. 2,922,101 and 2,761,245, kaolin or clay, etc. Furthermore, they can contain an optical whitening agent such as the stilbenes, triazines, oxazoles or coumarins as described in, for example, German Pat. Nos. 972,067 and 1,150,274, French Pat. No. 1,530,244 and U.S. Pat. Nos. 2,933,390 and 3,406,070. These optical whitening agents can be used as an aqueous solution or as a dispersion.

The heat developable light-sensitive materials of the present invention can additionally contain a plasticizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Pat. No. 955,061 can be used as plasticizers and lubricants. Furthermore, the light-sensitive materials can contain a surface active agent, for example, saponin and alkylaryl sulfonates described in, for example, U.S. Pat. No. 2,600,831, ampholytic compounds described in, for example, U.S. Pat. No. 3,133,816 and addition products of glycidol and alkyl phenols described in, for example, British Pat. No. 1,022,878. Hardenable layers of the heat developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxylic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, many additives can be used for increasing the density of the resulting images. For example, non-aqueous polar organic solvents such as compounds having a $$-\underset{\underset{O}{\|}}{C}-,\ -\underset{\underset{O}{\|}}{S}-\ \text{or}\ -SO_2-\ \text{group}$$

as described in U.S. Pat. No. 3,667,959, for example, tetrahydrothiophene-1,1-dioxide, 4-hydroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline on heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

Various methods can be utilized in order to prevent the generation of heat fog of the heat developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of heat fog is described in West German Patents (OLS) Nos. 2,326,865, 2,402,161 and 2,364,630, wherein N-halo compounds such as N-halosuccinimides or N-haloacetamides are used. Other methods for preventing the generation of heat fog are described in U.S. Pat. No. 3,645,739, West German Patent Application (OLS) 2,445,038, and Japanese Patent Applications (OPI) 89720/1973 and 125016.1974, wherein higher aliphatic acids such as lauric acid, myristic acid, palmitic acid, stearic acid or behenic acid, etc., tetrahalophthalic acids or the anhydrides thereof, aryl sulfonic acids such as benzene sulfonic acid or p-toluene sulfonic acid, aryl sulfinic acid or salts thereof such as benzene sulfinic acid or p-toluene sulfinic acid, and lithium salts of higher aliphatic acids such as lithium stearate, etc., are used as acid stabilizing agents. Other effective acid stabilizing agents include salicyclic acid, p-hydroxybenzoic acid, tetrabromobenzoic acid, tetrachlorobenzoic acid, p-acetamidobenzoic acid, alkyl substituted benzoic acids such a p-t-butylbenzoic acid, phthalic acid, isophthalic acid, trimellitic acid, pyromellitic acid, diphenic acid, and 5', 5'-methylene-bis-salicyclic acid. These acid stabilizing agents not only prevent the generation of heat fog but also sometimes have the functions of preventing discoloration when exposed to white light, increasing the image density or improving the shelf life (the property that the photographic properties of the light-sensitive material possessed just after production are maintained after storage). Other compounds which are effective for preventing generation of heat fog are benzotriazole and derivatives thereof, thiouracils, for example, 2-thiouracils represented by the formula (VIII):

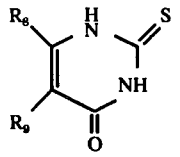

(VIII)

wherein $R_8$ represents a hydrogen atom; a hydroxyl group, an alkoxy group, a halogen atom, an unsubstituted or substituted lower alkyl group, a benzyl group, an allyl group, an amino group, a nitro group or a nitroso group, and $R_9$ represents a hydrogen atom, a hydroxyl group, a halogen atom, an amino group, an acetamido group an unsubstituted or substituted alkyl group having 1 to 22 carbon atoms, an aryl group, such as a phenyl group, or a substituted aryl group, mercapto compounds such as 1-phenyl-5-mercaptotetrazole, azole thioethers or blocked azolethiones, and peroxides or persulfates as described in Japanese Patent Application 5453/1974. Also, effective prevention of the generation of heat fog or improvement in photographic properties such as sensitization can be achieved if chromium salts, rhodium salts, copper salts, nickel salts, cobalt salts and complex salts of rhodium, iron or cobalt are present during formation or before formation of the silver halide.

In order to prevent discoloration by light of the processed light-sensitive material (the phenomenon in which the unexposed area of the light-sensitive material after processing is discolored gradually by light when exposed to normal room illumination), it is possible to use stabilizer precursors such as azole thioethers or blocked azolethiones as described in U.S. Pat. No. 3,839,049, tetrazolyl thio compounds as described in U.S. Pat. No. 3,700,457 and light-sensitive halogen-containing organic oxidizing agents as described in U.S. Pat. No. 3,707,377.

In addition, it is possible to use light absorbing dyes as described in British Pat. No. 1,261,102, for particularly, transmission light-sensitive materials in order to improve the resolving power. Further, it is possible to use leuco dye compounds described in, for example, West German Patent Application (OLS) 2,446,892 in order to improve the shelf life. It is also possible to increase the whiteness by blueing the elements using blue dyes such as Victoria Blue so that the color stain of dyes can be reduced, as described in Japanese Patent Application No. 22135/1974.

Further, it is possible in some cases to stabilize the processed light-sensitive materials to light or heat. Effective methods include the process described in U.S. Pat. No. 3,617,289 which comprises stabilizing the materials using a solution containing mercapto compounds and the method described in West German Patent Application (OLS) 2,443,292 which comprises providing a laminate containing a stablilizing agent.

Further, it is possible to provide, if desired, a top-coating polymer layer on the light-sensitive layer in order to enhance the transparency of the heat developable light-sensitive layer, to increase the image density and to improve the shelf life, as described in West German Patent Application (OLS) 2,323,452. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Pat. No. 798,367 and Japanese Patent Application (OPI) 46316/1975, provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

The heat developable light-sensitive layers, the top-coat polymer layer, a subbing layer, a back layer and other layers used in the present invention can be coated on a support using various coating methods. Examples of such methods are a dip-coating method, an air-knife coating method, a curtain coating method and a hopper coating method. If desired, two or more layers can be coated at the same time using the methods described in U.S. Pat. No. 2,761,791 and British Pat. No. 837,095.

The heat developable light-sensitive materials as in the present invention generally have the characteristic that the photographic properties thereof are easily deteriorated by moisture. Therefore, when the prepared light-sensitive materials are packed and sent into the trade as commodities, a drying agent, as described in West German Patent Application (OLS) 2,422,040, is generally packed with the materials.

The heat developable light-sensitive materials of the present invention can have a subbing layer between the support and the heat developable light-sensitive layer. Examples of binders which can be used for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as light-discoloration or heat fog, etc., by incorporating aliphatic acids or metal salts thereof in the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layers. Further, a non-electrolytic deposition layer composed of a conductive metal as described in U.S. Pat. No. 3,748,137 can be present. It is also possible to improve the moisture resistance or to prevent curling in case of a paper support by providing a hydrophobic polymer layer on the back of the support.

The heat developable light-sensitive materials of the present invention are cut to appropriate sizes and are developed by heating after image exposure.

The light-sensitive materials of the invention can be preheated before exposure to light as described above (to about 80° C to 140° C). Light sources suitable for image exposure are tungsten lamps, fluorescent lamps used for exposing diazotype light-sensitive materials, mercury lamps, xenon lamps, cathode ray tube (CRT) light sources and laser light sources, etc. As originals not only line images such as drawings but also photographic images having gradation can be used. Further, it is possible to directly photograph people and landscapes using a camera. The light-sensitive materials can be printed by direct contact of the light-sensitive material with the original, or can be printed using a reflection printing method or using an enlarged printing method. Although exposure depends upon the sensitivity of the light-sensitive materials, an exposure of about 10 lux.second is required for high speed sensitive materials and an exposure of about $10^4$ lux.second is required for low speed sensitive materials. The thus image-exposed light-sensitive materials can be developed simply by heating (e.g., to about 80° C to about 180° C, preferably about 100° C to about 150° C). The heating time can be suitably, for example, about 1 second to 60 seconds. The heating time, of course, is related to the heating temperature employed. In general, a suitable heating time is about 5 seconds to about 40 seconds at 120° C, about 2 seconds to about 20 seconds at 130° C and about 1 second to about 10 seconds at 140° C.

Various means can be used for heating. For example the light-sensitive material can be contacted with a simple heated plate or with a heated drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate certain perfumes so as to mask any bad odor of the light-sensitive materials which might be formed.

The preparation of heat developable light-sensitive materials of the invention will be illustrated by reference to the following examples and is briefly explained as follows.

An organic silver salt-forming agent is reacted with a silver ion-providing agent (e.g., silver nitrate) using one of the various methods described above to form an organic silver salt. The preparation conditions are at atmospheric pressure and a temperature of about −15° C to 80° C, preferably about 20° to 60° C. After washing the prepared organic silver salt with water or an alcohol, the salt is dispersed in a binder for an emulsion using a colloid mill, a mixer or a ball mill at normal temperature (e.g., about 15° to 25° C). To the polymer dispersion of the silver salt, a silver halide forming agent is added to convert a part of the organic silver salt to silver halide. In this case, the reaction temperature ranges from about normal temperature to about 80° C, and the reaction time is about 1 minute up to about 48 hours. Further, a previously prepared silver halide as described above can be added, or silver halide can be simultaneously prepared along with the organic silver salt. Then, any additives such as spectral sensitizing dyes, reducing agents or toning agents are added, preferably as solutions thereof. These solutions are usually added at suitable intervals (e.g., about 5 to 20 minutes) to the system with stirring at about normal temperature to 50° C. When all additives have been added, the coating composition is then coated on a suitable support using a coating apparatus. The temperature of the coating ranges from about 5 to 50° C. The drying temperature of the coated layers is about 3° to 100° C and the coating speed is about 3 to 150 meters/-min. If desired, the overcoating polymer layer, the subbing layer and the backing layer can be coated under similar conditions. Also, these additional layers can be simultaneously coated.

In accordance with the present invention, heat developable light-sensitive materials having reduced thermal fog after heat development, increased whiteness and extremely high light-stability are obtained.

The present invention will now be illustrated in greater detail by reference to the following example. Unless otherwise indicated herein, all parts, percents, ratios and the like are by weight.

EXAMPLE 1

1.9 g of sodium hydroxide was dissolved in 100 ml of water, with which 12 g of lauric acid in 100 ml of toluene was mixed to emulsify (at 25° C). An aqueous solution of 8.5 g of silver nitrate dissolved in 50 ml of water was then added to the above emulsion, which resulted in separation into a silver laurate-containing toluene phase and an aqueous phase. After removal of the aqueous phase, the toluene phase was dispersed into 200 ml of ethanol, and then, silver laurate was collected by centrifuging. 12 g of spindle-like silver laurate crystals of a longer diameter of about 3 $\mu$ was obtained.

A polymer dispersion of the silver salt was prepared by dispersing 6 g of the resulting silver laurate (about 1/50 mole) and 12 g of polyvinyl butyral into 70 g of ethyl alcohol using a mixer. The polymer dispersion of the silver salt was maintained at 50° C. 0.15 g of N-bromosuccinic imide (silver halide-forming component) was then added to the above polymer dispersion with stirring, and then the resultant mixture was allowed to stand for 90 minutes with stirring. After chill-setting the resultant mixture at 30° C, a heat developable light-sensitive coating solution was prepared by adding the components set-forth below in the listed order at 5 minute intervals to the above resultant mixture with stirring.

| COMPONENT | | |
|---|---|---|
| (1) | Sensitizing Dye* (0.025 wt % methyl Cellosolve solution) | 10 ml |
| (2) | Phthalazone (color toning agent) (3 wt % methanol solution) | 100 ml |
| (3) | 1,3,5-tris[3,5-Di-tert-butyl-4-hydroxybenzyl]-s-triazine-2,4,6-(1H, 3H, 5H)-trione (Compound 4) (reducing agent) (20% acetone solution | 40 ml |

*merocyanine dye represented by the following formula

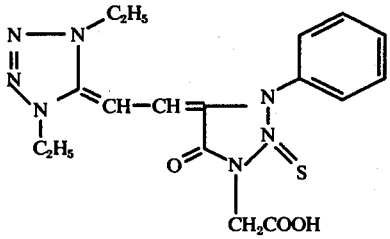

The resulting coating solution was then coated on an art paper support and on a polyethylene terephthalate film at a coverage of 0.3 g of silver per square meter in case of the paper, and 1.5 g of silver per square meter in case of the film. In case of the paper support, a dispersion, wherein silica was dispersed into a 10 wt% ethanol solution of ethyl cellulose (with the silica content being 1/10 of the amount of ethyl cellulose) was finally coated to form a polymer layer of a thickness of about 1.5 $\mu$. On the other hand, in case of the film support, a 15 wt% tetrahydrofuran solution of a vinyl chloride-vinyl acetate copolymer (85:15 monomer weight ratio) was finally coated to form a polymer layer of a thickness of about 3 $\mu$. The resulting heat developable light-sensitive materials were designated (1) and (1') respectively (The prime mark affixed to a sample designation indicates hereinafter a film support).

For the purpose of comparison with the above light-sensitive materials (1) and (1'), heat developable light-sensitive materials (2) and (2') were prepared in the same manner as the above light-sensitive materials (1) and (1') except that 25 ml of a 20% acetone solution of 2,2-bis(4-hydroxy-3,5-dimethylphenyl)propane was added as component (3).

These four kinds of heat developable light-sensitive materials (1), (1'), (2) and (2') were image-wise exposed to radiation from a tungsten light through an original having gradation (exposure amount: $10^4$ lux.-second), and then they were developed by heating at 140° C for 5 seconds.

The density of heat fog was examined for each heat developed sample. In addition, the extent of whiteness of each of the background thereof was compared visually. After exposure to diffuse sun light in the vicinity of a window, the image-stability to light was examined.

The heat fog densities of sensitive materials (1) and (1') were 0.06 and 0.09, respectively. The background of sensitive material (1) was superior to that of sensitive material (2) in regard to the whiteness thereof. The background of sensitive material (1') had a higher transparency than that of sensitive material (2'). Moreover, sensitive materials (1) and (1') were not essentially altered even under the conditions where the backgrounds of both sensitive materials (2) and (2') became yellow-brown. It is apparent from the above results that the reducing agent component of the present invention is excellent.

When, in the above procedures, benzene, pentane, cyclohexane, butyl acetate, isoamyl acetate, butyl alcohol, tricresyl phosphate, dibutyl phthalate and the like are used instead of toluene in the production of silver laurate above, similar results can be obtained. Further, when an equivalent amount of ethyl cellulose is employed as a binder instead of the polyvinyl butyral, similar results can be obtained, and when methanol, propanol, isopropanol are employed instead of the ethanol in producing the polymer dispersion of the silver salt, similar results can be obtained. In addition, when N-bromoacetamide, N-bromophthalazinone and other N-halo compounds are employed instead of the N-bromosuccimide as the silver halide-forming component, similar results can be obtained. Further, when in the above procedures, other merocyanine dyes, cyanine dyes and acidic dyes are employed instead of the merocyanine sensitizing dye used, similar results are obtained. In addition, other supports such as coated paper, papers for photographic materials, papers for pressure-sensitive materials, and polymeric film supports such as the polyethylene terephthalate above can be employed instead of an art paper and polyethylene terephthalate support used above to obtain similar results. Art paper and polyethylene terephthalate are preferred supports.

Examples of such supports include a cellulose acetate film, a polyester film, a polyamide film, a polyimide film, triacetate films, a polycarbonate film, a polyethylene glycol terephthalate (oriented polyester) film, a cellulose nitrate film, a cellulose ester film, a polyvinyl acetal film, a polyestyrene film, a polyethylene terephthalate (polyester) film colored with titanium dioxide, a film containing a heat-decloroable dye, a polyester film having a hydrophilic surface comprising a partially hydrolized vinyl chloride-vinyl acetate copolymer having dispersed silica therein a polyethylene terephthalate film having a gelatin undercoating layer, polyethylene terephthalate per se, and the like.

EXAMPLE 2

An aqueous solution of 0.8 g of cetylethyldimethyl ammonium bromide dissolved in 100 ml of water was mixed with 100 ml of toluene to form an emulsion. An aqueous solution of 0.425 g of silver nitrate in 10 ml of water was added to the emulsion to prepare silver bromide. The resulting silver bromide exsisted as an emulsion. A solution of 12 g of lauric acid in 100 ml of toluene was mixed with an aqueous solution of 1.9 g of sodium hydroxide in 100 ml of water to form an emulsion. The latter emulsion was added to the former emulsion.

Then a solution of 8.5 g of silver nitrate in 50 ml of water was added to the above mixed emulsion to result in the formation of silver laurate. Thus, a mixture, wherein silver bromide and silver laurate were in contact with each other, was obtained.

The crystals were collected by centrifuging, and then dispersed into 200 g of an ethanol solution containing 30 g of polyvinyl butyral using a mixer to prepare a polymer dispersion of the silver salt.

The polymer dispersion of the silver salt was maintained at 30° C, to which the following compounds were added in their listed order at 5 minute intervals to prepare a coating solution.

| | | |
|---|---|---|
| (1) | Dye* (0.025% methanol solution) | 10 ml |
| (2) | Phthalazone (phthaladinone) (color toning agent) (3 wt% methanol solution) | 80 ml |
| (3) | Same Reducing Agent as Component (3) in Example 1 (main reducing agent) (20% acetone solution) and | 84 ml |
| | 2,2''-Methylenebis[4-methyl-6-tert-butylphenol] (assistant reducing agent) (20% wt% acetone solution) | 2 ml |

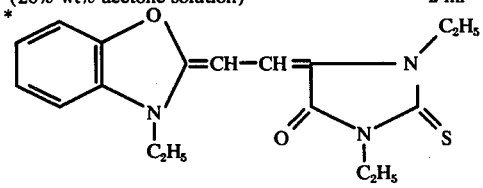

The resulting coating solution was coated on an art paper support at a coverage of 0.5 g of silver per square meter.

10 wt% acetone solution of cellulose diacetate containing 1.5 wt% of silica gel was then spread over the above light-sensitive layer as a final polymer layer in a thickness of 1 $\mu$ on a dry basis.

The heat developable light-sensitive material obtained by the above procedures was designated (1).

For the purpose of comparison with the above sensitive material (1), heat developable light-sensitive material (2) was prepared in the same manner as heat developable light-sensitive material (1) except that 48 ml of a 20 wt% acetone solution of 2,2-bis(4-hydroxy-3,5-dimethylphenyl)propane (an amount equivalent to the above-described main reducing agent) was added as the component (3). The materials were exposed and developed by heating under the same conditions as in Example 1. The sensitive materail (1) had less heat fog and a higher light-stability than sensitive material (2).

In a similar manner to the procedures described above, other oils which are comparatively difficulty miscible with water can be employed instead of the toluene used above to prepare the organic silver salt and also silver iodobromide, silver chlorobromide and silver chloroiodobromide can be employed instead of the silver bromide used above and further, other silver halide-forming components can be employed to produce simultaneously the silver halide in a manner similar to that used to prepare the silver bromide above instead of the acetylethyldimethyl ammonium bromide employed above. Further, other silver salts of fatty acids such as silver myristate and silver palmitate can be employed instead of the silver laurate to achieve substantially the same results. In a similar manner, alcohols such as methanol, n-propyl alcohols, isopropyl alcohols and the like can be used instead of the ethanol used above to prepare the polymer dispersion of the silver salt with similar results. Further, other sensitizing dyes such as merocyanine dyes, cyanine dyes, rhodacyanine dyes, styril dyes and acidic dyes can be employed instead of the sensitizing dye used above with similar results being obtained.

EXAMPLE 3

20 ml of a 2.5 wt% aqueous solution of hydrogen bromide was added to a solution of 8.6 g of capric acid in 100 ml of butyl acetate which was maintained at a temperature of 50° C and stirred with a stirrer, resulting in the formation of an emulsion. 50 ml of an aqueous solution of silver nitrate-ammonium complex containing 8.5 g of silver nitrate (chill-set at 5° C) was added dropwise into the resulting emulsion over a 30 second period to allow the capric acid and hydrogen bromide to react simultaneously with silver ion. Silver caprate and silver bromide were then formed at the same time. After removal of the aqueous phase, the butyl acetate phase containing both silver caprate and silver bromide was dispersed into 120 g of a 15 wt% isopropnaol solution of polyvinyl butyral to form a polymer dispersion. The components (kept at 40° C) set forth below were added to the polymer dispersion in their listed order at 5 minute intervals.

The resulting coating solution was coated on a support as was used in Example 1 at a coverage of 0.7 g of silver per square meter. Thus, heat developable light-sensitive material (1) was obtained.

For the purpose of comparison with heat developable light-sensitive material (1), heat developable light-sensitive material (2) was prepared in the same manner as light-sensitive material (1) except that 110 ml (equivalent amount) of 3-bis[3,5-di-tert-butyl-4-hydroxybenzyl]-5-dodecyl-s-triazine-2,4,6-(1H, 3H, 5H)-trione (Compound 2) was added to the above polymer dispersion as component (4) of the present invention.

(1) Lauric Acid (acid stabilizer)

-continued

| | | |
|---|---|---|
| | (5 wt% methanol solution) | 50 ml |
| (2) | Tetrachlorotetrabromofluorescein (sensitizing dye) (0.025% wt% methanol solution) | 72 ml |
| (3) | Phthalazone (color toning agent) (2.5% wt% methyl Cellosolve solution) | 80 ml |
| (4) | Bisphenol A (reducing agent) (20 wt% methyl Cellosolve solution) | 27 ml |

The materials were then processed in the same manner as in Example 1.

Sensitive material (1) was unsuitable for practical use because of a large amount of heat fog in the background thereof, while sensitive material (2) had an extemely high degree of whiteness, and that essentially no change caused by exposure to diffuse light in the vicinity of a window could be observed with this sensitive material (2).

The above result demonstrates that component (4) of the present invention is excellent.

EXAMPLE 4

3.4 g of behenic acid was dissolved in 100 ml of benzene at 60° C, and the solution was adjusted to a temperature of 60° C. With stirring, 100 ml of water was added to the above solution to form an emulsion. Aqueous ammonia was added to 80 ml of an aqueous solution containing 1.7 g of silver nitrate to prepare a silver-ammine complex, and then water was further added to make the total volume 100 ml.

The resulting silver-ammine complex-containg solution, which was chill-set at 10° C, was added to the above emulsion, resulting in the formation of crystals of silver behenate. This mixed solution was warmed to normal temperature (25° C), and allowed to stand for 20 minutes. Then, the mixture separated into an aqueous phase and a benzene phase. After removal of the aqueous phase, the benzene phase was washed with 400 ml of water by decantation. 400 ml of methanol was then added to the benzene phase, from which silver behenate was collected by centrifuging. 4 g of spindle-like silver behenate of a longer diameter of about 1 $\mu$, and a shorter diameter of about 0.05 $\mu$, was obtained.

2.3 g of the resulting silver behenate (about 1/200 mole) was dispersed in 20 ml of an ethanol solution containing 2.5 g of polyvinyl butyral for 1 hour using a ball mill. The several components set-forth below were added to the polymer dispersion in their listed order at 5 minute intervals while being kept at a temperature of 50° C.

| | | |
|---|---|---|
| (1) | Ammonium Bromide (silver halide-forming component) (2.5 wt% methanol solution) | 1 ml |
| (2) | Sensitizing Dye* (0.025 wt% solution in methyl Cellosolve) | 1 ml |
| (3) | 2,2'-Methylenebis(6-t-butyl-4-methylphenol) (reducing agent) (25 wt% acetone solution) | 3 ml |
| (4) | Phthalazone (color toning agent) (2.5 wt% methyl Cellosolve solution) | 3 ml |

*merocyanine dye represented by the following formula

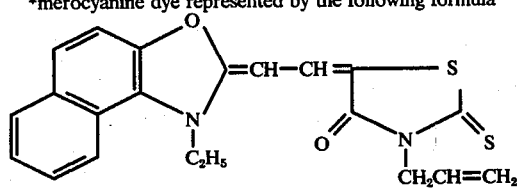

A coating solution prepared according to the above procedures was coated on a support as was used in Example 1 at a coverage of 1 g of silver per square meter, resulting in the preparation of heat developable light-sensitive material (1).

For the purpose of comparison, heat developable light-sensitive material (2) was prepared in the same manner as heat developable light-sensitive material (1) except that as component (3) both 1 ml of a 25% acetone solution of 2,2'-methylene bis(6-tert-butyl-4-methylphenol) and 7 ml of a 25% acetone solution of 1,3-bis[3,5-di-tert-butyl-4-hydroxybenzyl]-s-triazine-2,4,6-(1H, 3H, 5H)-trione (Compound 5) were employed.

Each of heat developable light-sensitive materials (1) and (2) was image-exposed to radiation from a tungsten light through an original having a gradation (exposure amount: $10^4$ lux. second), and then developed by heating at 120° C for 20 seconds.

In sensitive material (1), the heat fog density of the background was 0.55. When sensitive material (1) was allowed to stand for one day in the vicinity of a window, it was colored a yellowish brown by sun light. On the other hand, sensitive material (2) had a heat fog density in the background measuring 0.05, and provided a very beautiful copy. The light-stability was tested under the same conditions as sensitive material (1).

No change caused by exposure to sun light could be observed.

Such an excellent effect as above is due to the phenol with steric hindrance which is used in combination with the reducing agent.

Instead of a tungsten light source, a mercury lamp, a xenon light source, a CRT light source, a fluorescent lamp and a laser beam were also effectively used if the exposure amount was adjusted to the same amount as the tungsten light employed. In addition, development under the conditions of a temperature of 120° C for 20 seconds provided almost the same results as the above.

In a similar manner to the preparation of the organic silver salt, toluene, xylene, pentyl acetate, isomyl acetate and the like can be used instead of benzene to prepare the silver behenate. Further, methanol, propanol, and isopropanol can be effectively used in preparing the polymer dispersion of the silver salt as a replacement for the ethanol employd in the above procedures. Further, an equivalent amount of an inorganic halide such as hydrogen bromide, sodium bromide, potassium bromide, calcium bromide, antimony bromide, and the like can be employed instead of the ammonium bromide used in the above procedures without the photographic characteristics being affected. Further, merocyanine dyes, particularly those containing a carboxyl group and a rhodamine, thiohydantoin, or 2-thio-2,4-oxazolidine dione nucleus can be employed. Further, supports such as a coated paper, a photographic paper and a polymeric film such as polyethylene therephthalate can be employed as the support similar to the support above.

EXAMPLE 5

Coating samples (2) and (3) were prepared in the same manner as sensitive material (1) in Example 1 except that as the reducing agent (3), 2,6-di-t-butyl-4-cresol and 2,4,6-tri-t-butylphenol was employed, respectively, instead of Compound 4 of the invention. These materials were exposed and developed in the same manner as in Example 1. The density of the image area was examined for each sample. An image of a pure black tone could be obtained in sensitive material (1), but both sensitive materials (2) and (3) provided purple-tinged grey images. Therefore, beautiful copies could not be obtained with both sensitive materials (2) and (3).

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having therein or in one or more layers thereon (a) an organic silver salt, (b) a light-sensitive silver halide or a component capable of forming a light-sensitive silver halide by reaction with the organic silver salt, and (c) as a reducing agent an s-triazine-2,4,6-(1H, 3H, 5H)-trione substituted with a phenol derivative having a substituted group in at least one ortho-position thereof with respect to the hydroxyl group thereof) in at least one of the 1-, 3- or 5-positions.

2. The heat developable light-sensitive material of claim 1, wherein said reducing agent has the general formula (I)

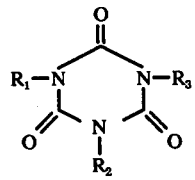

wherein $R_1$, $R_2$ and $R_3$ each represents a hydrogen atom, and alkyl group having 1 to 16 carbons or a Q group, with at least one of $R_1$, $R_2$, and $R_3$ being a Q group; and the Q group being represented by the general formula (II)

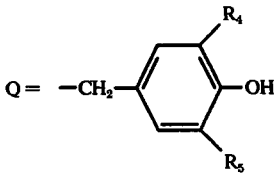

wherein $R_4$ represents an alkyl group having 1 to 20 carbons atoms, and $R_5$ represents a hydrogen atom or an alkyl group as described for $R_1$, which alkyl group may be the same as or different from $R_1$.

3. The heat developable light-sensitive material of claim 2, wherein the alkyl group for $R_4$ is a methyl, an ethyl group, a propyl group, an isopropyl group, a butyl group, a secondary butyl group, a tertiary butyl group, a 1,1-dimethylpropyl group, a hexyl group, an octyl group, a decyl group, a dodecyl group, a tetradecyl group, or a hexadecyl group.

4. The heat-developable light-sensitive material of claim 3, wherein $R_4$ is a tertiary butyl group, a dodecyl group, or a hexadecyl group.

5. The heat-developable light-sensitive material of claim 2, wherein said reducing agent is 1,3,5-tris-[3,5-Di-tert-butyl-4-hydroxybenzyl]-s-triazine-2,4,6-(1H, 3H, 5H)-trione.

6. The heat-developable light-sensitive material of claim 1, wherein said organic silver salt is a silver salt of an organic compound containing an imino group, a mercapto group, a thione group or a carboxyl group.

7. The heat-developable light-sensitive material of claim 6, wherein said organic silver a salt is an organic silver carboxylate.

8. The heat-developable light-sensitive material of claim 7, wherein said organic silver salt is a silver salt of an aliphatic long chain fatty acid.

9. The heat-developable light-sensitive material of claim 1, wherein said reducing agent comprises a mixture of said trione and another reducing agent as an assistant reducing agent.

10. The heat-developable light-sensitive material of claim 9, wherein said other reducing agent is a substituted phenol, an unsubstituted or substituted bisphenol, an unsubstituted or substituted bisnaphthol, a di- or polyhydroxybenzene, a di- or polyhydroxynaphthalene, a hydroquinone monoether, ascorbic acid or a derivative thereof, a 3-pyrazolidone, a pyrazolin-5-one, a reducing saccharide, a p-phenylenediamine or a derivative thereof, a reductone, kojic acid, hinokitiol, a hydroxylamine, a hydroxytetronic acid, a hydroxytetraonamide, a hydroxyoxamic acid, a sulfohydrooxamic acid, a hydrazide, an indan-1,3-dione, a p-oxyphenylglycyine, an ester of a carboxylic acid derived from a phenol having a bulky substituent in at least one orthoposition with a monohydric or polyhydric alochol or phenol, or an ester of an alochol derived from a phenol having a bulky substituent in at least one ortho-position or a phenol having a bulky substituent in at least one ortho-position with a mono- or polycarboxylic acid.

11. The heat-developable light-sensitive material of claim 1, wherein said reducing agent is present in an amount of about 0.1 mole to 10 mole per mole of said organic silver salt.

* * * * *